US005146057A

United States Patent [19]

Hellebuyck et al.

[11] Patent Number: 5,146,057

[45] Date of Patent: Sep. 8, 1992

[54] ANTIREFLECTIVE SWITCH

[75] Inventors: Charles G. Hellebuyck, Troy; Syed M. Khalid, Canton, both of Mich.

[73] Assignee: Ford Motor Company, Dearborn, Mich.

[21] Appl. No.: 787,703

[22] Filed: Nov. 4, 1991

Related U.S. Application Data

[63] Continuation of Ser. No. 579,011, Sep. 7, 1990, abandoned.

[51] Int. Cl.[5] ..... H01H 9/02

[52] U.S. Cl. ..... 200/313; 200/312

[58] Field of Search ..... 200/314, 311, 312, 313, 200/310; 116/DIG. 5, DIG. 27, DIG. 28

[56] References Cited

U.S. PATENT DOCUMENTS

| | | | |
|---|---|---|---|
| 2,673,914 | 3/1954 | Sundt | 200/313 |
| 2,954,632 | 10/1960 | Ambrose | 116/DIG. 28 |
| 3,157,771 | 1/1964 | Roeser | 200/314 |
| 3,715,548 | 1/1973 | Schadow | 116/DIG. 28 |
| 3,755,661 | 8/1973 | Bouvrande | 200/314 X |
| 3,895,204 | 7/1975 | Lewis | 200/314 |
| 4,310,871 | 1/1982 | Adachi | 362/23 |
| 4,359,618 | 11/1982 | Stevens | 200/314 |
| 4,385,221 | 5/1983 | Dörfler | 200/314 |
| 4,489,227 | 12/1984 | Lamarche | 200/314 |
| 4,694,130 | 9/1987 | Kitzmann et al. | 200/314 |
| 4,771,725 | 9/1988 | Miyaguchi et al. | 200/314 X |
| 4,772,769 | 9/1988 | Shumate | 200/314 |
| 4,947,011 | 8/1990 | Muranoi et al. | 200/313 |
| 5,045,656 | 9/1991 | Kojima | 200/314 |

*Primary Examiner*—Henry J. Recla
*Assistant Examiner*—David J. Walczak
*Attorney, Agent, or Firm*—Paul K. Godwin, Jr.; Roger L. May

[57] ABSTRACT

A backlit switch for use on the instrument panel of an automotive vehicle that eliminates virtual images in the line of sight of a vehicle operator. The switch provides a legend which is spaced back from a clear transparent lens element and oriented to have its normal below the normal of the lens element. The lens element provides an actuation surface which is substantially normal to the force exerted by the operator's finger.

3 Claims, 1 Drawing Sheet

ANTIREFLECTIVE SWITCH

This application is a continuation of application Ser. No. 07/579,011, filed Sep. 7, 1990, now abandoned.

BACKGROUND OF THE INVENTION

1. Field of the Invention

The present invention is directed to the field of actuatable switches and more specifically to the area of backlighting such switches.

2. Description of the Prior Art

It is commonly known that manually actuatable switches, such as those used in automotive vehicles, are backlit using various light piping techniques. U.S. Pat. Nos. 2,673,914 and 4,385,221 are typical of switches which are backlit to display indicia. However, when such switches are employed on the instrument Panel of automotive vehicles, there is a tendency for the displayed indicia to present a virtual image that is in the reflected line of sight of the vehicle operator as the operator is looking through the windshield.

U.S. Pat. No. 4,310,871 illustrates how care is taken to shield illuminated instruments in the vehicle to prevent such reflections. The '871 patent illustrates the use of a hood arrangement to block reflected images that may otherwise occur from the windshield.

Athough the approach utilized in the '871 patent is useful for instrumentation, it is often not convenient or stylistically desirable to place hoods over illuminated switches. It is desirable to Place switches where they are easily accessible, directly viewable and positioned to provide an actuation surface which is generally normal to the actuation force placed on it by the operator's finger.

SUMMARY OF THE INVENTION

The present invention provides a switch that is positionahle for easy access and directly viewable by a vehicle operator. It has a backlit indicia for direct viewing by the operator and is out of the reflected line of sight of the operator when that operator is looking through the windshield, thus preventing a virtual image of the indicia from appearing in the windshield. The switch of the present invention includes a front lens element mounted on an opaque housing to provide an actuation surface that can be positioned so as to be both substantially normal to the force exerted by the operator's finger and directly viewable by the operator. The switch also includes a planar indicia element that provides the switch legend and is spaced from the lens element in the housing. In that manner, the backlit legend is directly viewable by the operator through the lens element but yet out of the reflected line of sight when the operator is looking through the windshield. The indicia is backlit and, because of the spacing and positioning characteristics, no light from the switch is directed towards the windshield when the indicia is illuminated at night. The planar indicia element is angularly displaced from the lens element so that a normal to its surface would extend below the horizontal reference. In a desired position on the vehicle the switch is positioned so that a normal to the surface of the lens element would extend along or slightly above the horizontal.

DETAILED DESCRIPTION OF THE PREFERRED EMBODIMENT

Figure 1:
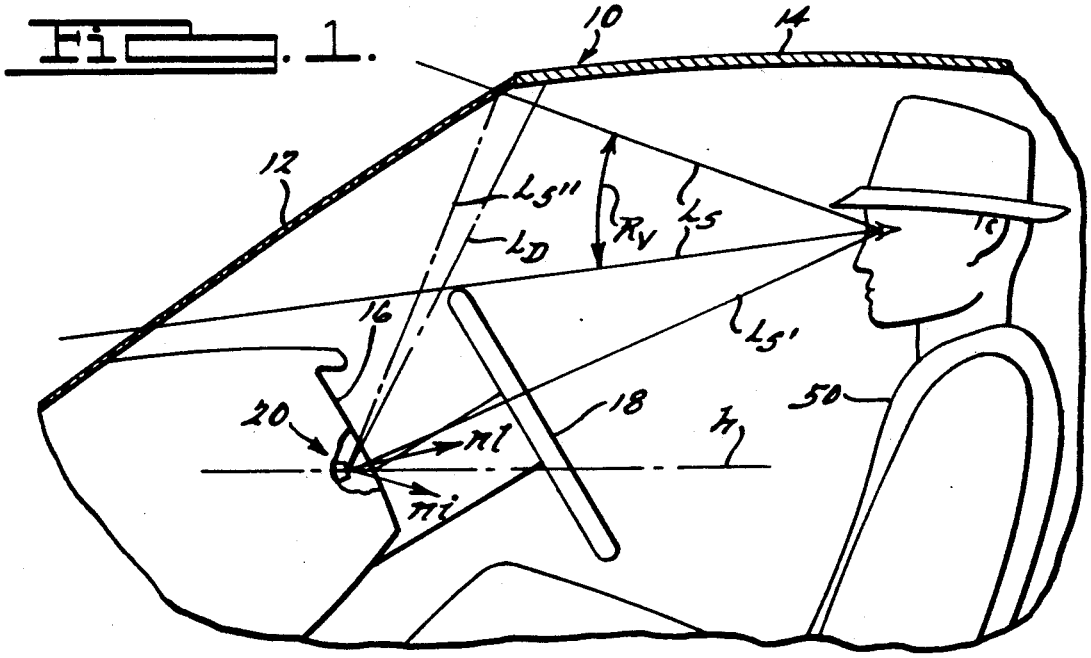
FIG. 1 is an elevational cross-section of an interior portion of a vehicle in which the relative location of a switch of the present invention is depicted.

In FIG. 1 a portion of an automotive vehicle 10 is shown that contains a roof 14, a windshield 12, an instrument panel 16 and a steering wheel 18. A vehicle operator 50 seated in the vehicle will have a line of sight $L_s$ when looking through the windshield 12 ranging over an angle $R_v$ from the position shown through the top of the windshield to the base of the windshield. Since most windshields in current design vehicles have a low rake angle, there is an area near the top of the windshield represented as a reflected line of sight $L_s''$ along which virtual images of bright elements on the dashboard 16 may be perceived by the operator 50. Of course, vehicle designers wish to minimize the occurances of such virtual images when they are not relevant to the operation of the vehicle.

The present invention eliminates virtual images of backlit switches from appearing on the windshield. A switch 20, which contains the present invention, is depicted as being positioned on the instrument panel 16 in the passenger compartment. A horizontal reference line "h" is drawn through the switch 20 for reference purposes. The switch 20 is configured so that light projected from its front actuation surface does not reach the windshield 12, but is directed substantially towards the operator 50 and below the reflected line of sight $L_s''$.

Figure 2:
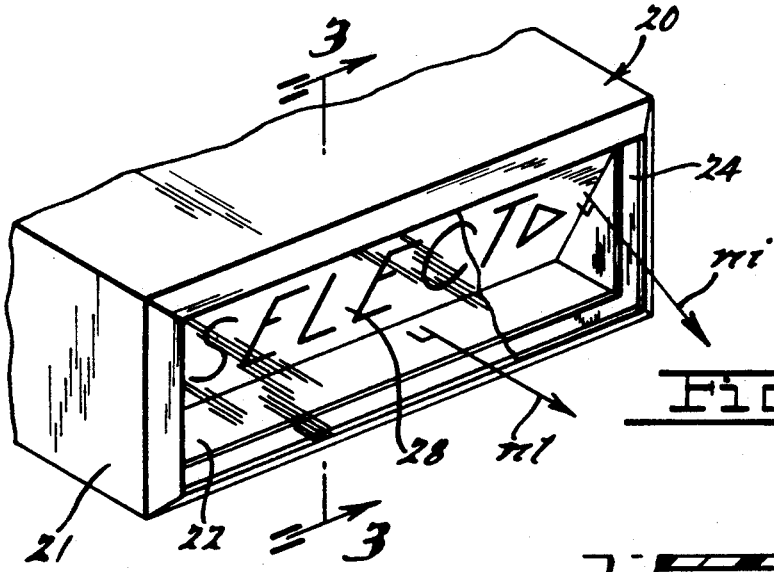
FIG. 2 is a perspective view of the switch of the present invention.
Figure 3:
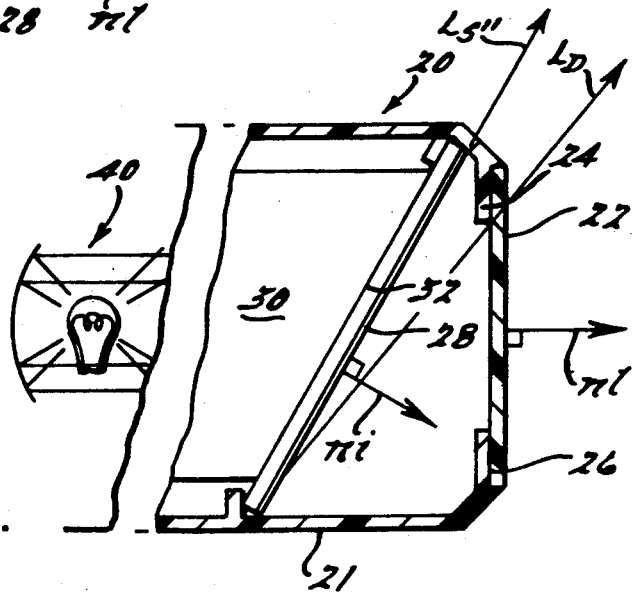
FIG. 3 is a cross-sectional diagram taken along the lines III—III of FIG. 2.

In FIGS. 2 and 3, switch 20 of FIG. 1 is shown in greater detail to illustrate the invention. Switch 20 is a manually actuatable backlighted switch that is normally positioned on the instrument panel below the windshield and forward of the vehicle operator (as shown in FIG. 1). An opaque switch housing 21 is oriented to provide an opening directed towards the vehicle operator. A transparent lens element 22 is positioned on flanges 24 and 26 extending from the housing 21. The lens element 22 provides a manually actuatable surface lying in a plane that has a normal nl conventionally oriented above the horizontal reference when mounted on the dashboard 16 of the instrument panel of the vehicle. A light diffusing indicia element 28 is located within the switch housing 21 and is spaced from the lens element 22 in such a manner as to be shielded by the housing and sufficiently out of the reflective line of sight of the operator when the operator 50 is looking through the windshield 12. The indicia element 28 lies in a plane having a normal ni which if extended would be directed below the horizontal reference h (Also see FIG. 1). The indicia element contains contrasting letters or other markings that would indicate to the operator the purpose of the switch. The indicia element 28 is directly visible by the operator 50 along line of sight $L_s'$ when viewed through the lens 22. However, because of its orientation and spacing from the lens element, it is not within the reflected line of sight $L_s''$ of the operator. Backlighting is provided from a remote light source 40 routed through light piping element 30. The light piping element 30 has a cleaved face 32 that is coplaner with the indicia element 28 so as to efficiently transfer light through the translucent portions of the indicia element 28 and the lens 22. The diffused light that is transmitted thorough the indicia element 28 and lens element 22 is restricted by the housing 21 and flange 24 to an upwards direction represented as $L_D$ which, when projected, does not impinge on the windshield.

During night time operation, the light transmitted through the indicia element 28 and the lens 22 is directly viewable by the operator 50, but because of the orientation and position of the indicia element 28 within the housing 21, no virtual image of the lighted switch is preceived by the operator when the operator is looking through the windshield.

It will be apparent that many modifications and variations may be implemented without departing from the scope of the novel concept of this invention. Therefore, it is intended by the appended claims to cover all such modifications and variations which fall within the true spirit and scope of the invention.

I claim:

1. A manually actuatable backlighted pushbutton switch for use by an operator in an automotive vehicle having an instrument panel and a windshield forward of a vehicle operator seating position comprising:

an opaque switch housing mounted on said instrument panel and having a flanged opening formed therein;

a planar light transmitting lens element positioned on said flanged opening of said switch housing for movement in response to manual depression contact during switch actuation and viewing by an operator seated in said operator seating position;

a light pipe element within said switch housing for transmitting light from a remote light source through said lens element;

a planar light diffusing indicia element between said light pipe element and said lens element movable with said lens element during said manual depression by said operator;

said light diffusing indicia element being angularly oriented with respect to said lens element within said switch housing so that light transmitted from said remote light source, through said diffusing indicia element and said lens element is directed toward said operator for viewing and prevented by said housing and the flange of said flanged opening from being directed towards said windshield.

2. A switch as in claim 1, wherein said light diffusing indicia element has a planar surface adjacent to said planar lens element and said light diffusing indicia element surface lies in a plane having a normal that extends at an angle below a normal to the lens element.

3. A switch as in claim 1, wherein said light pipe element has a light projecting end adjacent said light diffusing indicia element cleaved along a surface parallel to said indicia element.

* * * * *